US006420835B1

(12) United States Patent
Chen et al.

(10) Patent No.: US 6,420,835 B1
(45) Date of Patent: Jul. 16, 2002

(54) COLOR PLASMA DISPLAY PANEL

(75) Inventors: Po-Cheng Chen, Yung-Ho; Jiun-Han Wu, Sanchung; Chien-Hsing Li, Tai-Chung, all of (TW)

(73) Assignee: AU Optronics, Hsinchu (TW)

( * ) Notice: Subject to any disclaimer, the term of this patent is extended or adjusted under 35 U.S.C. 154(b) by 0 days.

(21) Appl. No.: 09/725,028

(22) Filed: Nov. 29, 2000

(51) Int. Cl.[7] ..... G09G 3/28
(52) U.S. Cl. ..... 315/169.4; 313/486; 345/60
(58) Field of Search ..... 315/169.4, 169.1, 315/169.3; 313/582, 584, 586, 484, 485, 486; 345/55, 60; 445/24

(56) References Cited

U.S. PATENT DOCUMENTS 5,754,003 A * 5/1998 Murai et al. ..... 313/582
5,825,128 A * 10/1998 Betsui et al. ..... 313/485
5,892,492 A * 4/1999 Osawa et al. ..... 313/485
6,013,983 A * 1/2000 Asano et al. ..... 313/112
6,239,551 B1 * 5/2001 Park ..... 313/292
6,288,488 B1 * 9/2001 Amemiya ..... 313/582

* cited by examiner

*Primary Examiner*—Haissa Philogene
*Assistant Examiner*—Ephrem Alemu
(74) *Attorney, Agent, or Firm*—Winston Hsu

(57) ABSTRACT

A plasma display panel includes a rear plate, a front plate parallel to and spaced apart from the rear plate, and a plurality of ribs between the plates to define a plurality of discharge space groups therebetween. Each discharge space group includes a first discharge space and a second discharge space. A first fluorescent layer is coated in the first discharge space and on a first side wall surface of the ribs surrounding the first discharge space, and a second fluorescent layer is coated in the second discharge space and on a second side wall surface of the ribs surrounding the second discharge space. A second thickness of the second fluorescent layer is larger than a first thickness of the first fluorescent layer so that the surface area of the first fluorescent layer is larger than the surface area of the second fluorescent layer.

9 Claims, 3 Drawing Sheets

COLOR PLASMA DISPLAY PANEL

BACKGROUND OF THE INVENTION

1. Field of the Invention

The present invention provides a color plasma display panel, and more particularly, to a color plasma display panel that can adjust the covering area of fluorescence layer to increase the color temperature.

2. Description of the Prior Art

Color plasma display panels (PDP) is teamed up with several hundred thousand display units in permutations and combinations which is several hundred micrometers in size, the light source comes from applying a voltage on a discharging gas in order to produce ultraviolet rays. When the ultraviolet rays incident on different fluorescent layer, the fluorescent layers will emit three colors: red, green and blue. Generally speaking, the material of the fluorescent layer determines the color emitted from the fluorescent layer. When the fluorescent material contains $(Y,Gd)BO_3$ and Eu, a red fluorescent ray will be produced; when the fluorescent material contains $ZnSO_4$ and Mn, a green fluorescent ray will be produced; when the fluorescent material contains $BaMgAl_{14}O_{23}$ and Eu, a blue fluorescent ray will be produced.

However, the fluorescent material becomes degraded because of heat, therefore, the quality of the blue fluorescent ray is poor. The present technique for improving the luminescent quality of color plasma display panel is to enlarge the discharge space of blue fluorescent ray in order to increase the covering area of the fluorescent material. In the meanwhile, the ratio of red fluorescent ray, blue fluorescent ray, and blue fluorescent ray is adjusted in order to increase the color temperature of PDP from 7000° K. to 11000° K.

Referring to FIG. 1, FIG. 1 is a schematic diagram of color plasma display panel 10 in according to the prior art. The prior art color display panel 10 comprises a first substrate 12, a second substrate 14 parallel to the first substrate 12, a discharge gas (not shown) that fills the space between the first substrate 12 and the second substrate 14, a plurality of first electrodes 18, a plurality of second electrodes 20, and a plurality of addressing electrodes 22. Each of the first electrodes 18 and each of the second electrodes 20 is positioned on the first substrate 12 in parallel. Each of the address electrodes 22 are positioned on the second substrate 14 and are orthogonal to the first electrodes 18 and the second electrodes 20.

Each of the first electrodes 18 and the second electrodes 20 respectively comprises a sustaining electrode 181, 201, and an auxiliary electrode 182, 202. The sustaining electrode 181, 201 is usually made of indium tin oxide (ITO), and the auxiliary electrode 182, 202 is usually made of a Chrome/Copper/Chrome (Cr/Cu/Cr) metal alloy. The sustaining electrode 181, 201 has high resistance, but is transparent to visible light. The auxiliary electrode 182, 202 has a good conductivity and is used to increase the conductivity of the first electrode 18 and second electrode 20.

The plasma display panel 10 further includes a dielectric layer 24 that covers the surfaces of the first substrate 12. A protective layer 26 then covers the dielectric layer 24. A plurality of barrier ribs 28 are positioned in parallel on the second substrate 14 to define a plurality of discharge spaces 30 of strip shape. Each addressing electrode 22 is positioned between two adjacent barrier ribs. A fluorescent layer 32 coats on the bottom of each discharge spaces 30 and the side wall of the barrier rib 28 within each discharge space 30 in order to produce the red, green or blue rays. Each of the discharge space 30 comprises a plurality of display unit 34, and all of the display units 34 are arranged between the first substrate 12 and the second substrate 14.

In addition, all of the stripy shaped discharge space 30 consists of a plurality of discharge space set, each discharge space set includes a red discharge space 30R coated with red fluorescent layer 32R, a green discharge space 30G coated with green fluorescent layer 32G, and a blue discharge space 30B coated with blue fluorescent layer 32B. Therefore, a plurality of red display units 34R are formed within the red discharge space 30R, a plurality of green display units 34G are formed within the green discharge space 30G, a plurality of blue display units 34B are formed within the blue discharge space 30B. A red display unit 34R, a green display unit 34G, and a blue display unit 34B is defined as a pixel.

As mentioned above, in order to improve the quality of the blue fluorescent light, the width of the blue discharge space 30B will be enlarged. The width of the red discharge space 30R is designed as the narrowest one, the width of the green discharge space 30G is designed as the medium one, and the width of the blue discharge space 30B is designed as the largest one. The width of the green discharge space is about 1.2 times of the width of the red discharge space 30R, and the width of the blue discharge space 30B is about 1.6 times of the width of the red discharge space 30R in according to the prior art. Therefore, the space of the red display unit 34R is the smallest one, the space of the blue display unit 34B is the largest one in order to adjust the ratio of red, green, and blue fluorescent light from plasma display panel 10. Therefore, the surface area of the blue fluorescent layer 32B coated in blue display unit 34B will be the largest, the surface area of the red fluorescent layer 32R coated in red display unit 34R will be the smallest. Therefore, when the discharge gases are discharged to produce visible lights, the amount of blue light will be larger. Therefore, the red, green, and blue lights are mixed subtly to reach the white balance state, and the color temperature of color plasma display panel 10 is. increased to around 11000° K.

However, the resolution of the plasma display panel is continuous increased and the widths of all discharge spaces begin to shrink. Since the ratio of the widths of the discharge spaces 30 is designed as a fixed proportion, the width of the red discharge space 30R is then very small. Hence, it becomes difficult to manufacture the barrier rib 28 and the red fluorescent layer 32R. The alignment of the first substrate 12 and the second substrate 14 becomes difficult, too. In addition, the width of the red discharge space 30R is too narrow so the cross-talk problem of the discharge gas is increased to cause interferences, and further influence the electrical performance of the color plasma display panel 10.

SUMMARY OF THE INVENTION

It is an object of the present invention to provide a color plasma display panel having a higher color temperature and a higher covering area of the fluorescent layer.

In accordance with the preferred embodiment of the present invention, the plasma display panel comprises a rear plate having a rear plate surface thereon, a front plate parallel to and spaced apart from the rear plate forms a space between the front plate and the rear plate. A first, a second, and a third barrier ribs are positioned on the rear plate, these ribs are formed in parallel and spaced apart from each other by a predetermined distance. The space between the first barrier rib and the second barrier ribs is defined as a first discharge space, and the space between the second and the third barrier ribs is defined as a second discharge space. The plasma display panel further comprises a first bottom rib positioned on a first region of the rear plate surface in the first discharge space, and a second bottom rib positioned on a second region of the rear plate surface in the second discharge space. The first bottom rib has a first thickness and the second bottom rib has a second thickness. A first fluorescent layer is coated on the surface of the first bottom rib and the sidewall surface of the barrier rib surrounding the first discharge space. A second fluorescent layer is coated on the surface of the second bottom rib and the side wall surface of the barrier rib surrounding the second discharge space. The first fluorescent layer has a first surface area and the second fluorescent layer has a second surface area. The second thickness of the second bottom rib is larger than the first thickness of the first bottom rib, so that the first surface area of the first fluorescent layer in the first discharge space is larger than the second surface area of the second fluorescent layer in the second discharge space.

In addition, the plasma display panel further comprises a fourth barrier rib parallel to the third barrier rib and spaced apart from the third rib the predetermined distance on the rear plate. The space between the fourth barrier rib and the third barrier rib is defined as a third discharge space. A third bottom rib is positioned on a third region of the rear plate surface in the third discharge space, and the third bottom rib has a third thickness. A third fluorescent layer is coated on the surface of the third bottom rib and the side wall surface of the barrier rib surrounding the third discharge space. The third fluorescent layer has a third surface area. The third thickness of the third bottom rib is larger than the first thickness of the first bottom rib so that the third surface area of the third fluorescent layer in the third discharge space is smaller than the first surface area of the first fluorescent layer in the first discharge space.

In another preferred embodiment of the present invention, the plasma display panel comprises a rear plate having a rear plate surface thereon, and a front plate parallel to and spaced apart from the rear plate for forming a space between the rear plate and the front plate. A plurality of barrier ribs are positioned within the space, the ribs are formed in parallel and spaced apart from each other by a predetermined distance so as to define a plurality of discharge space groups therebetween. Each group comprises a first, a second, and a third discharge space. These spaces have a substantially equal volume. The plasma display panel further includes a first, a second, and a third fluorescent layer. The first fluorescent layer is coated on a first region of the rear plate surface in the first discharge space and a first sidewall surface of the rib surrounding the first discharge space. The second fluorescent layer is coated on a second region of the rear plate surface in the second discharge space and a second sidewall surface of the rib surrounding the second discharge space. The third fluorescent layer is coated on a third region of the rear plate surface in the third discharge space and a third sidewall surface of the rib surrounding the third discharge space. The first fluorescent layer has a first thickness, the second fluorescent layer has a second thickness, and the third fluorescent layer has a third thickness. The third thickness of the third fluorescent layer coated in the third discharge space is the largest, the first thickness of the first fluorescent layer coated in the first discharge space is the smallest, so that the surface area of the first fluorescent layer coated on the side wall surface of the barrier rib surrounding the first discharge space is larger than the surface area of the third fluorescent layer coated on the barrier rib surrounding the third discharge space.

In the present invention, the distances between the surfaces of the bottom ribs and the front plate are different or the thickness of each fluorescent layers are different so that the surface area of the fluorescent layer coated on each discharge space will be different. Therefore, the ratio of the three nature colors will be changed to reach a better white balance state. The color temperature of the plasma display panel is also increased to about 11000° K., the problems cause by the misalignment of the plates and the cross talk phenomenon of the discharge gas can be avoided at the same time.

These and other objectives of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
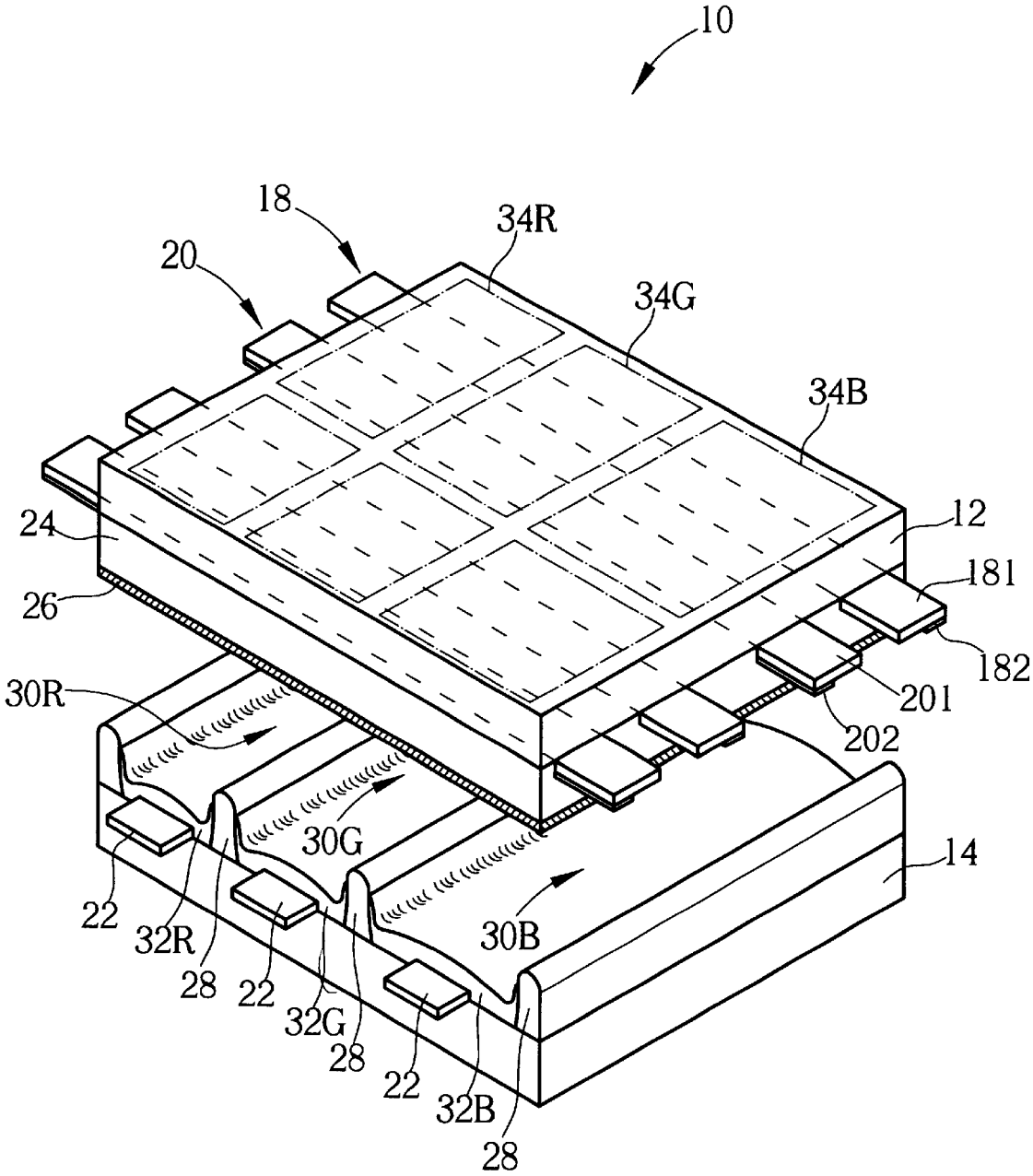
Fig. 1 Prior art
FIG. 1 is a schematic diagram of the color plasma display panel according to the prior art.
Figure 2:
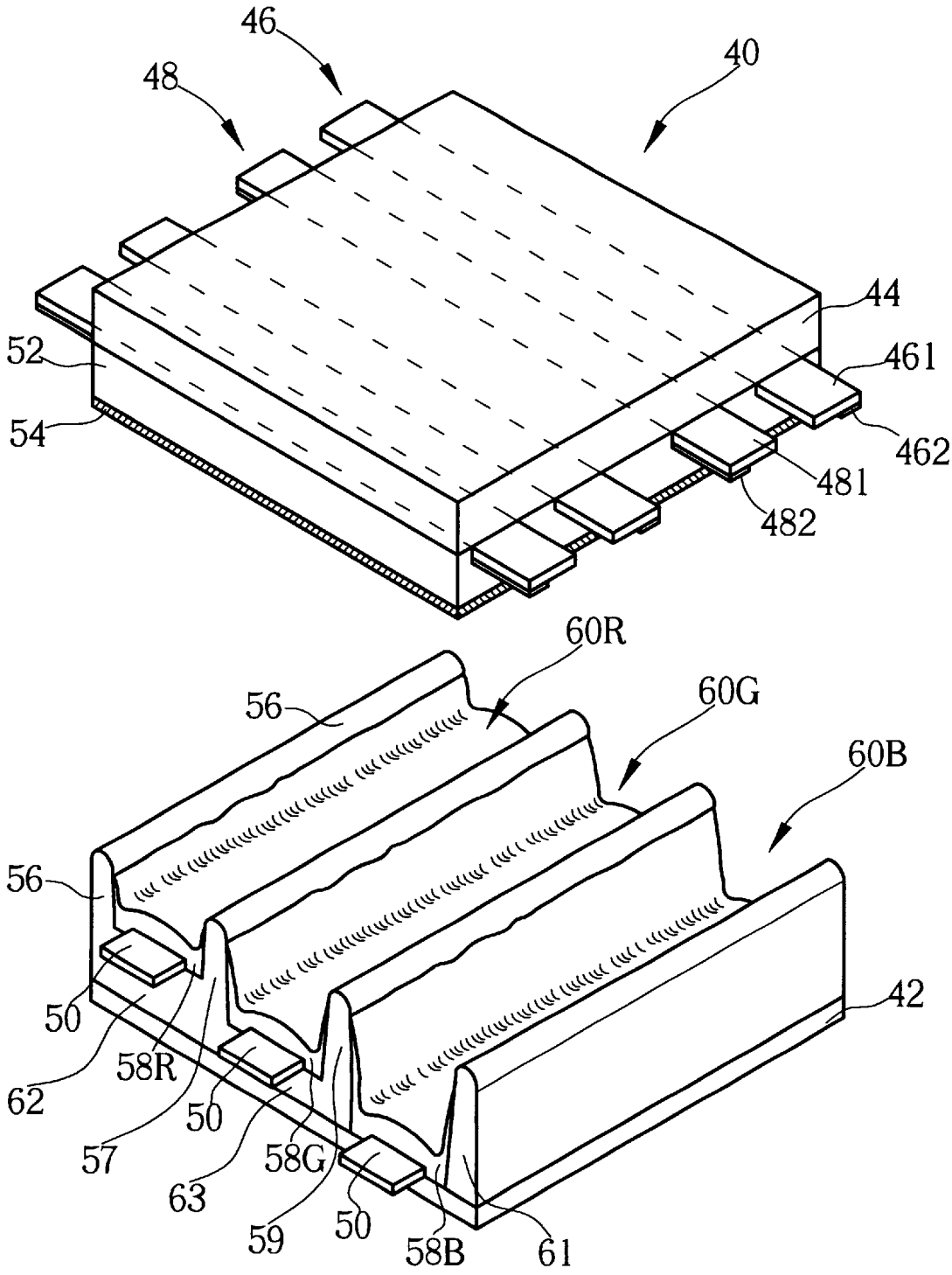
FIG. 2 is a schematic diagram of the color plasma display panel according to the first preferred embodiment of the present invention.

Please refer to FIG. 2. FIG. 2 is a schematic diagram of the color plasma display panel 40 according to the first preferred embodiment of the present invention. The color plasma display panel 40 includes a rear plate 42 having a rear plate surface, and a front plate 44 parallel to and spaced apart from the rear plate 42 for forming a space between the rear plate and the front plate. A plurality of first electrodes 46 and second electrodes 48 are formed on the front plate 44. A dielectric. layer 52 further covers the front plate 44, and a protective layer 54 covers the dielectric layer 52. A discharge gas is filled in the space between the front plate 44 and the rear plate 42.

In addition, a plurality addressing electrodes 50 are positioned, on the rear plate 42. Each of the first electrodes 46 and the second electrode 48 is orthogonal to the addressing electrode 50. Each of the first electrodes 46 and the second electrodes 48 comprises a sustaining electrodes 461–481, respectively, and a auxiliary electrodes 462–482, respectively. The sustaining electrodes 461–481, used for surface discharge, are made of indium tin oxide (ITO), or tin oxide (SnO) but have high-resistance. The auxiliary electrodes 462–482 have good conductivity characteristics so as to increase the conductivity of the first electrode 46 and the second electrode 48. The auxiliary electrodes 462–482 are usually made of Chrome/Copper/Chrome(Cr/Cu/Cr) metal alloy or Silver (Ag).

The color plasma display panel 40 further comprises a first barrier rib 56, a second barrier rib 57, a third barrier rib 59, and a fourth barrier rib 61 formed on the rear plate 42 in parallel and spaced apart from each other by a predetermined distance. The space between the first and the second barrier ribs 56–57 is defined as the first discharge space, the space between the second and the third barrier ribs 57–59 is defined as the second discharge space, and the space between the third and the fourth barrier ribs 59–61 is defined as the third discharge space. According to this preferred embodiment, the first discharge space is a red discharge space 60R, the second discharge space is a green discharge space 60G, and the third discharge space is a blue discharge space 60B. Each of the red discharge space 60R, the green discharge space 60G, and the blue discharge space 60B is coated with a red fluorescent layer 58R, a green fluorescent layer 58G, and a blue fluorescent layer 58B, respectively.

A first bottom rib 62 and a second bottom rib 63 are further formed on parts of the rear plate surface of the rear plate 42 in the red discharge space 60R and the green discharge space 60G, respectively. The blue discharge space might have another bottom ribs or not. In this embodiment, there is no bottom rib inside the blue discharge space 60B. These "bottom ribs" 62–63 are not used to "separate" different fluorescent materials. Further, the bottom ribs 62–63 are formed in the same process for manufacturing the barrier ribs 56–57–59–61, the material of the bottom ribs are the same as the barrier ribs. The first bottom rib 62 has a first thickness and the second bottom rib 63 has a second thickness. The first thickness is different from the second thickness in order to form discharge spaces with different depth. There is no bottom rib formed in blue discharge space 60B so the blue discharge space 60B is the deepest, the green discharge space 60G is the secondary, the red discharge space 60R is the shallowest.

As shown in FIG. 2, the blue fluorescent layer 58B is coated on the surface of the rear plate 42 in the blue discharge space 60B and the side wall surface of the barrier ribs 59–61 surrounding the blue discharge surface 60B. The green fluorescent layer 58G is coated on the surface of the second bottom rib 63 in green discharge space 60G and the side wall surface of the barrier ribs 57–59 surrounding the green discharge space 60G. The red fluorescent layer 58R is coated on the surface of the first bottom rib 62 in red discharge space 60R and the side wall surface of the barrier ribs 56–57 surrounding the red discharge space 60R.

In the present invention, the common printing method is used for making these barrier ribs 56–57–59–61 having regular interval and different depth. First, one layer of rib material is printed on the rear plate 42. These barrier ribs 56–57–59–61 are then formed by a sand-blasting(or etching) process and used to define the pattern of each discharge space 60.

These barrier ribs have approximate equal height, and the depth of each discharge space remains the same. Further, a wet photoresist layer is formed in the red discharge space 60R, a second sand-blasting process removes a portion of the ribs inside the green and blue discharge space 60G–60B until the green discharge-space 60G reaches the required depth. Then, a second wet photoresist layer is formed inside the red and green discharge spaces 60R–60B, a third sand-blasting process removes the rib in the blue discharge space 60B for forming the green discharge space with required depth. The residual barrier rib at the bottom portion of the red discharge space 60R is defined as the first bottom barrier rib 62, and the residual barrier rib at the bottom portion of the green discharge space 60G is defined as the second bottom rib 63. Finally, different fluorescent layers 58R–58G–58B are formed in different discharge spaces 60. These fluorescent layers are used to produce different lights but have substantially the same thickness.

Refer to FIG. 2, the depth of the red discharge space 60R is the smallest so the surface area of the red fluorescent layer 58R coated in the red discharge space 60R is the smallest. The depth of the blue discharge space 60B is the largest, therefore, the surface area of the blue fluorescent layer 58B coated in the blue discharge space 60B is the largest. When the visible lights are produced, the amount of the blue light will be increased. By adjusting the mixing ratio of the red, green, and blue light, the better white balance state can be reached and the color temperature of the color plasma display panel 40 can be increased to 11000° K. According to the design of the present invention, the luminescent efficiency of blue fluorescent material can be improved by increasing the surface area of the blue fluorescent material. The surface area of the blue fluorescent material is the biggest, the surface area of the green fluorescent material is the secondary, and the surface area of the red fluorescent material is the smallest. In practical design, only the surface area of blue fluorescent material is larger than that of the red fluorescent material, the surface area of green fluorescent material can be the same as or smaller than that of the blue fluorescent material.

When the size of the color plasma display panel is small, all of the discharge spaces become small. In the meanwhile, the barrier ribs still can be arranged with regular intervals. The surface area of the fluorescent layer 58 in each discharge space 60 can be adjusted by different depth of each discharge space 60, so it's not necessary to over shorten the intervals between the barrier ribs. Therefore, not only to simply the manufacturing process, but also to avoid the cross talk phenomenon of a discharge gas. The electrical performance of the color plasma display panel 40 can be also increased.

In addition, the surface area of the fluorescent layer in each discharge space can be changed by adjusting the thickness of the fluorescent layer.

Figure 3:
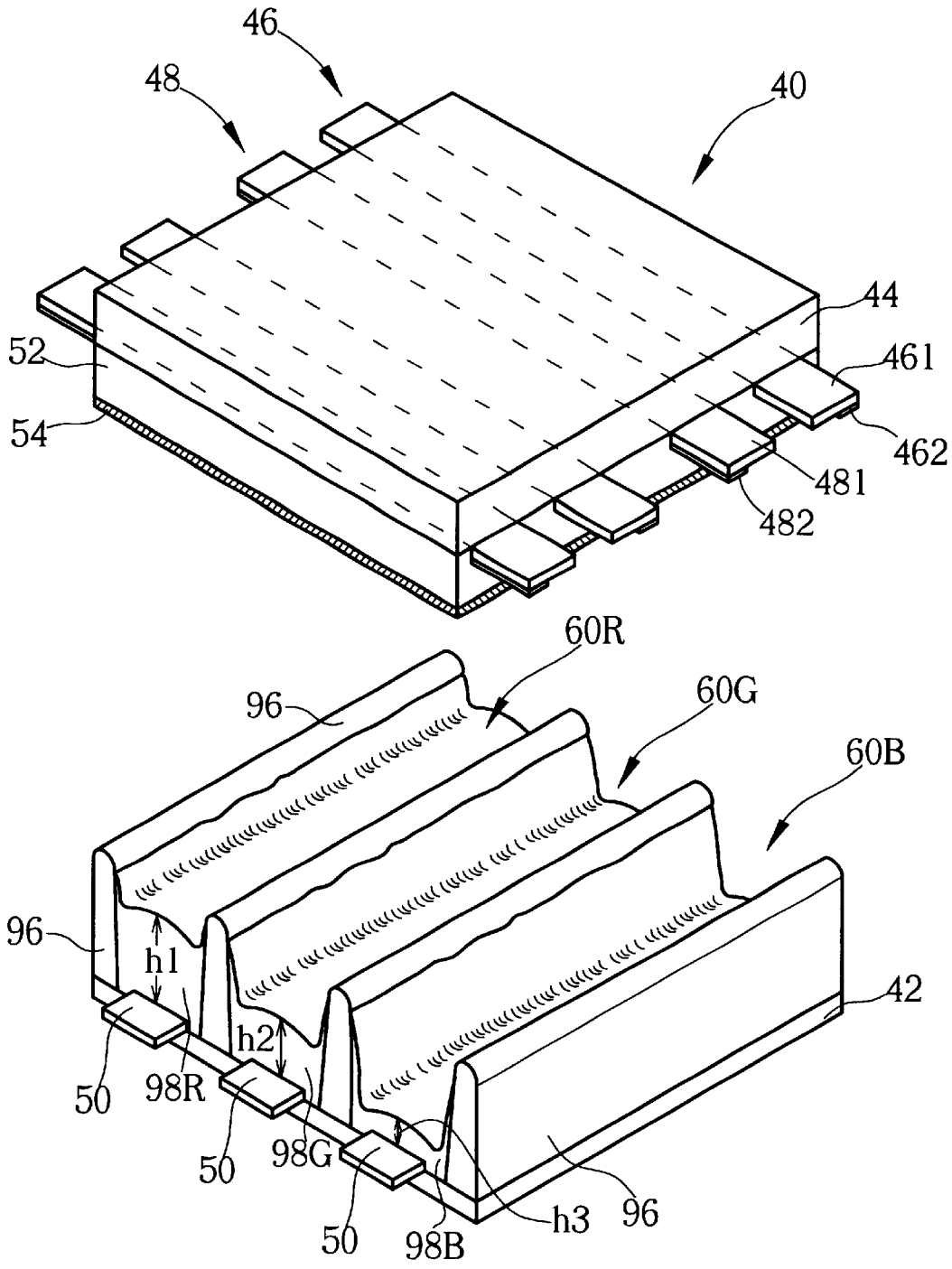
FIG. 3 is a schematic diagram of the color plasma display panel according to the second preferred embodiment of the present invention

Referring to FIG. 3., FIG. 3 is a schematic diagram of the second preferred embodiment of the color plasma display panel 40 of present invention. The same indication numbers are adapted if the structure is the same as the first preferred embodiment as shown in FIG. 2. The color plasma display panel 40 comprises a rear plate 42 having a rear plate surface, a plurality of addressing electrodes 50 positioned on the rear plate 42, a front plate 44 parallel to and spaced apart from the rear plate 42 for forming a space between the rear plate 42 and the front plate 44. The color plasma display panel 40 further includes a plurality of the first electrodes 46 and second electrodes 48 positioned on the front plate 44, a dielectric layer 52 covered on the front plate 44, and a protective layer 54 covered on the dielectric layer 52. In addition, a plurality of barrier ribs 96 are formed on the rear plate 42, these ribs are formed in parallel and spaced from each other to form discharge spaces by a predetermined distance in order to define a plurality of discharge space group. Each discharge space comprises the first, the second and the third discharge space. As shown in FIG. 3, the first, the second and the third discharge spaces are the red discharge space 60R, the green discharge space 60G, and the blue discharge space 60B, respectively. The red fluorescent layer 98R, the green fluorescent layer 98G, and the blue fluorescent layer 98B are coated in these discharge space. The volumes of these discharge spaces are approximately equal.

As shown in FIG. 3 , the heights of the barrier ribs 96 in each discharge space 60 are the same, so each discharge space 60 has the same depth. On the other hand, the red fluorescent layer 98R coated in red fluorescent discharge space 60R has a thickness hi, the blue fluorescent layer 98B coated in blue fluorescent discharge space 60B has a thickness h3, and the green fluorescent layer 98G coated in green fluorescent discharge space 60G has a thickness h2. The thickness h1 is bigger than the thickness h2, and the thickness h2 is bigger than the thickness h3. So the surface area of the red fluorescent layer 98R coated on the side wall of the barrier ribs in red discharge space 60R is the smallest, while the surface area of the blue fluorescent layer 98B coated on the side wall of the barrier ribs in blue discharge space 60B is the largest. This will increase the ratio of the blue fluorescent light and increase the color temperature of the plasma display panel 40 to about 11000K.

Compared to the prior art, in the present invention, the color plasma display panel has a plurality of parallel ribs spaced apart from a predetermined distance. The different fluorescent layers have different surface areas by adjusting the depth of the ribs or the thickness of the fluorescent layers in the discharge spaces. By increasing the amount of blue light, the ratio of three primary colors is changed to increase the color temperature and reach a better white balance of the color plasma display panel. Therefore, the quality of the plasma display panel will be increased.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma display panel comprises:

a rear plate having a rear plate surface thereon;

a front plate parallel to and spaced apart from the rear plate for forming a space between the rear plate and the front plate;

a plurality of ribs positioned in the space, the ribs being formed in parallel and spaced apart from each other by a predetermined distance so as to define a plurality of discharge space groups therebetween, each discharge space group comprising a first discharge space and a second discharge space;

a first fluorescent layer coated on a first region of the rear plate surface in the first discharge space and a first side wall surface of the ribs surrounding the first discharge space, the first fluorescent layer having a first fluorescent layer thickness and a first fluorescent layer width; and a second fluorescent layer coated on a second region of the rear plate surface in the second discharge space and a second side wall surface of the ribs surrounding the second discharge space, the second fluorescent layer having a second fluorescent layer thickness and a second fluorescent layer width, the second fluorescent layer width being substantially the same as the first fluorescent layer width;

wherein a first surface area is defined as the surface area of the first fluorescent layer coated on the first sidewall surface of the ribs surrounding the first discharge space, and a second surface area is defined as the surface area of the second fluorescent layer coated on the second side wall surface of the ribs surrounding the second discharge space, wherein the second fluorescent layer thickness is not larger than the first fluorescent layer thickness so that the second surface area of the second fluorescent layer coated on the second side wall surface of the ribs surrounding the second discharge space is larger than the first surface area of the first fluorescent layer coated on the first side wall surface of ribs surrounding the first discharging space.

2. The plasma display panel of claim 1 wherein the discharge space group further comprises:

a third discharge space; and a third fluorescent layer coated on a third region of the rear plate surface in the third discharge space and a third side wall surface of the ribs surrounding the third discharge space, the third fluorescent layer having a third fluorescent layer thickness;

wherein a third surface area is defined as the surface area of the third fluorescent layer coated on the third side wall surface of the ribs surrounding the third discharge space, and the third fluorescent layer thickness is not larger than the first fluorescent layer thickness so that the third surface area of the third fluorescent layer coated on the third side wall surface of ribs surrounding the third discharging space is larger than the first surface area of the first fluorescent layer coated on the first side wall surface of ribs surrounding the first discharging space.

3. The plasma display panel of claim 1 wherein the volumes of the first, the second, and the third discharge spaces are substantially the same.

4. The plasma display panel of claim 1 wherein the first fluorescent layer is a red fluorescent layer, the second fluorescent layer is a green fluorescent layer, and the third fluorescent layer is a blue fluorescent layer.

5. A plasma display panel comprises:

a rear plate having a rear plate surface thereon;

a front plate spaced above and in parallel with the rear plate;

a first, second, and third ribs positioned in parallel on the rear plate and spaced apart from each other by a predetermined distance, wherein a first discharge space is formed between the first and the second ribs, and a second discharge space is formed between the second and the third ribs;

a first bottom rib positioned on, a first region of the rear plate surface in the first discharge space, the first bottom rib having a first thickness;

a second bottom rib positioned on a second region of the rear plate surface in the second discharge space, the second bottom rib having a second thickness;

a first fluorescent layer coated on a surface of the first bottom rib and side wall surfaces of ribs surrounding the first discharge space; and a second fluorescent layer coated on a surface of the second bottom rib and side wall surfaces of ribs surrounding the second discharge space;

wherein the second thickness of the second bottom rib is less than the first thickness of the first bottom rib, so that the surface area of the first fluorescent layer coated on the side wall surfaces of the ribs in the first discharge space is less than the surface area of the second fluorescent layer coated on the side wall surfaces of the ribs in the second discharge space.

6. The plasma panel display of claim 5 wherein the rear plate further comprises:

a fourth rib parallel to the third rib and spaced apart from the third rib by a predetermined distance, a third discharge space being formed between the fourth rib and the third rib;

a third bottom rib positioned on a third region of the rear plate surface in the third discharge space, the third bottom rib having a third thickness; and a third fluorescent layer positioned on a surface of the third bottom rib and side wall surfaces of the ribs surrounding the third discharge space;

wherein the third thickness of the third bottom rib is less than the first thickness of the first bottom rib, so that the surface area of the third fluorescent layer coated on the side wall surfaces of the ribs in the third discharge space is larger than the first surface area of the first fluorescent layer coated on the side wall surfaces of the ribs in the first discharge space.

7. The plasma display panel of claim 5 wherein the distance between the surface of the first bottom rib and the front plate is a first distance, the distance between the surface of the second bottom rib and the first plate is a second distance, and the first distance is less than the second distance so that the first surface area of the first fluorescent layer coated on the side wall surfaces of ribs in the first discharge space is less than the second surface area of the second fluorescent layer coated on the side wall surfaces of ribs surrounding in the second discharge space.

8. The plasma display panel of claim 5 wherein the distance between the surface of the first bottom rib and the front plate is a first distance, the distance between the surface of the third bottom rib and the front plate is a third distance, the third distance is larger than the first distance so that the third surface area of the third fluorescent layer coated on the side wall surfaces of the ribs surrounding the third discharge space is larger than the first surface area of the first fluorescent layer coated on side wall surfaces of ribs surrounding the first discharge space.

9. The plasma display panel of claim 5 wherein the first fluorescent layer is a red layer, the second fluorescent layer is a green layer, and the third fluorescent layer is a blue layer.

* * * * *